United States Patent [19]

Morrison

[11] Patent Number: 4,538,124

[45] Date of Patent: Aug. 27, 1985

[54] PLANAR MICROWAVE CIRCUIT COMPONENT MOUNTING SYSTEM

[75] Inventor: Melvin M. Morrison, Paterson, N.J.

[73] Assignee: RCA Corporation, Princeton, N.J.

[21] Appl. No.: 579,186

[22] Filed: Feb. 10, 1984

[51] Int. Cl.[3] ..... H01P 1/00

[52] U.S. Cl. ..... 333/246; 174/52 R; 333/247; 361/412; 361/386

[58] Field of Search ..... 333/246, 247, 260; 361/400, 403, 404, 412, 413; 174/52 R

[56] References Cited

U.S. PATENT DOCUMENTS

| | | | |
|---|---|---|---|
| 3,670,215 | 6/1972 | Wilkens et al. . | |
| 3,689,804 | 9/1972 | Ishihama et al. . | |
| 3,775,644 | 11/1973 | Cotner et al. | 333/246 X |
| 3,846,825 | 11/1974 | Budde . | |
| 3,859,570 | 1/1975 | Veranth et al. . | |
| 3,943,469 | 3/1976 | Kawamoto et al. | 333/247 |
| 3,982,271 | 9/1976 | Olivieri et al. | 333/247 X |
| 4,143,342 | 3/1979 | Cain et al. | 333/246 X |
| 4,208,642 | 6/1980 | Saunders | 333/246 |
| 4,455,537 | 6/1984 | La Prade et al. | 333/246 X |

*Primary Examiner*—Paul Gensler

*Attorney, Agent, or Firm*—Joseph S. Tripoli; George E. Haas; William Squire

[57] ABSTRACT

The plane of the leads of a field effect transistor are spaced from a transistor housing surface a distance which may have any value in a given range. The leads are soldered or welded to respective planar conductors of a microwave circuit and the housing is soldered to a heat sink pedestal on a base. The microwave circuit is fixedly secured to the base at one end and adjustably secured to the pedestal at the other end to compensate for the variations in the spacing between the plane of the leads and the housing at that other end.

10 Claims, 3 Drawing Figures

PLANAR MICROWAVE CIRCUIT COMPONENT MOUNTING SYSTEM

This invention relates to a planar microwave circuit system and, in particular, to a transistor mounting arrangement for the system.

Of interest is copending patent application entitled "Microwave Circuit Interconnect System," by J. N. LaPrade et al., Ser. No. 280,919, filed July 6, 1981, now U.S. Pat. No. 4,455,537 and assigned to the assignee of the present invention.

A microwave circuit system may include various planar conductors on one surface of a thin, planar dielectric alumina substrate and a ground plane conductor at a reference potential on the opposite surface of the substrate. Planar microwave circuit elements on one substrate often are connected to other such circuit elements on a different substrate. In some instances, the circuit elements on one substrate are required to be coupled to transistors which may also be connected to other such circuit elements on a different substrate. In the aforementioned copending application, one such exemplary microwave circuit system is disclosed. There, a field effect transistor (FET) is required to be coupled between two planar microwave circuits on different substrates.

However, there may occur, at times, various problems in coupling such a transistor to the planar microwave circuitry. One problem occurs in implementing the circuit in a compact package while maximizing power and the frequency range of the system. One major source of concern in that kind of system is the operating temperature of the field effect transistor, when operated at relatively high power. Heat generated by the transistor needs to be dissipated.

Generally, the transistor body includes a metal flange that has a mounting surface which is soldered to a metal interface support structure in the system. The interface support structure, made of Kovar, a trademark for a particular metal, is secured to a metal base, usually aluminum. The heat generated by the transistor is expected to flow through the Kovar interface support structure to the base, which serves as a heat sink. However, Kovar is a relatively poor heat conductor compared to aluminum.

The Kovar interface support structure also carries the substrates, on which are the microwave circuits. The coefficient of thermal expansion of Kovar is matched to that of the substrate, which may be alumina, to preclude thermal expansion variations therebetween and, therefore, avoid fracture of the alumina substrate when cycled through extreme thermal temperature excursions. This necessitates the continued use of Kovar as the optimum material for supporting the substrate.

Also, the leads of the FET are heat paths. If the leads are long, they tend to dissipate excessive heat in their vicinity and this may be undesirable. For this reason, the leads should be as short as possible.

A second area of concern relates to the tuning of the circuit including the FET to the desired operating frequency. FETs generally have internal capacitance that limit their frequency response. Line capacitance in the contacts between the substrate conductors and the gate and drain leads of the FET further limit the system operating frequency. Generally, FET flanges are soldered in place at their mounting surfaces, as mentioned above. The FET gate and drain leads are connected by soldering or welding them to the planar conductors on the alumina substrates. Among different FETs, there generally is a variation in distance from FET to FET between the plane of their leads and their corresponding mounting surface.

The gate and drain electrodes due to the variation of their spacing from the corresponding mounting surface among different FETs, in one implementation need be bent to contact the conductors on the alumina substrates. This introduces latent stresses which later may cause stress failure of the soldered connection of the leads to the mating conductors. In the alternative, the gap between the leads and the conductor may be filled with solder. In some instances, both the latent stresses and the gap may be present. In either case, the frequency of operation of the system may become more restricted. This is because the gap, if present, may create increased line capacitance and thus reduce the frequency of operation and, correspondingly, the bandwidth of the system. Assembly of the FET to such a circuit and the required tuning of the associated circuits is difficult due to this increased line capacitance. To avoid this problem, in a second implementation, the heat sink interface structure supporting each different FET is specially fabricated to accommodate the dimensions of a preselected individual FET to be attached to that assembly. This can be cumbersome and costly, especially if that FET needs to be replaced by a different FET. Also, due to the spacing variation, the gate and drain leads are made relatively long to complete the circuit and that increased lead length has the disadvantage discussed above.

According to the present invention, the improvement of such a system described above comprises at least one thermally and electrically conductive component receiving surface on the base to which the component mounting surface can be secured. The component receiving surface lies in a plane spaced from the plane of the conductor on the substrate to which a component lead may be secured. Means are coupled to the substrate support structure and the base for setting the spacing distance between the plane of the substrate planar conductor and the component receiving surface to substantially the value of the distance between the lead of the component and its mounting surface.

IN THE DRAWING

Figure 1:
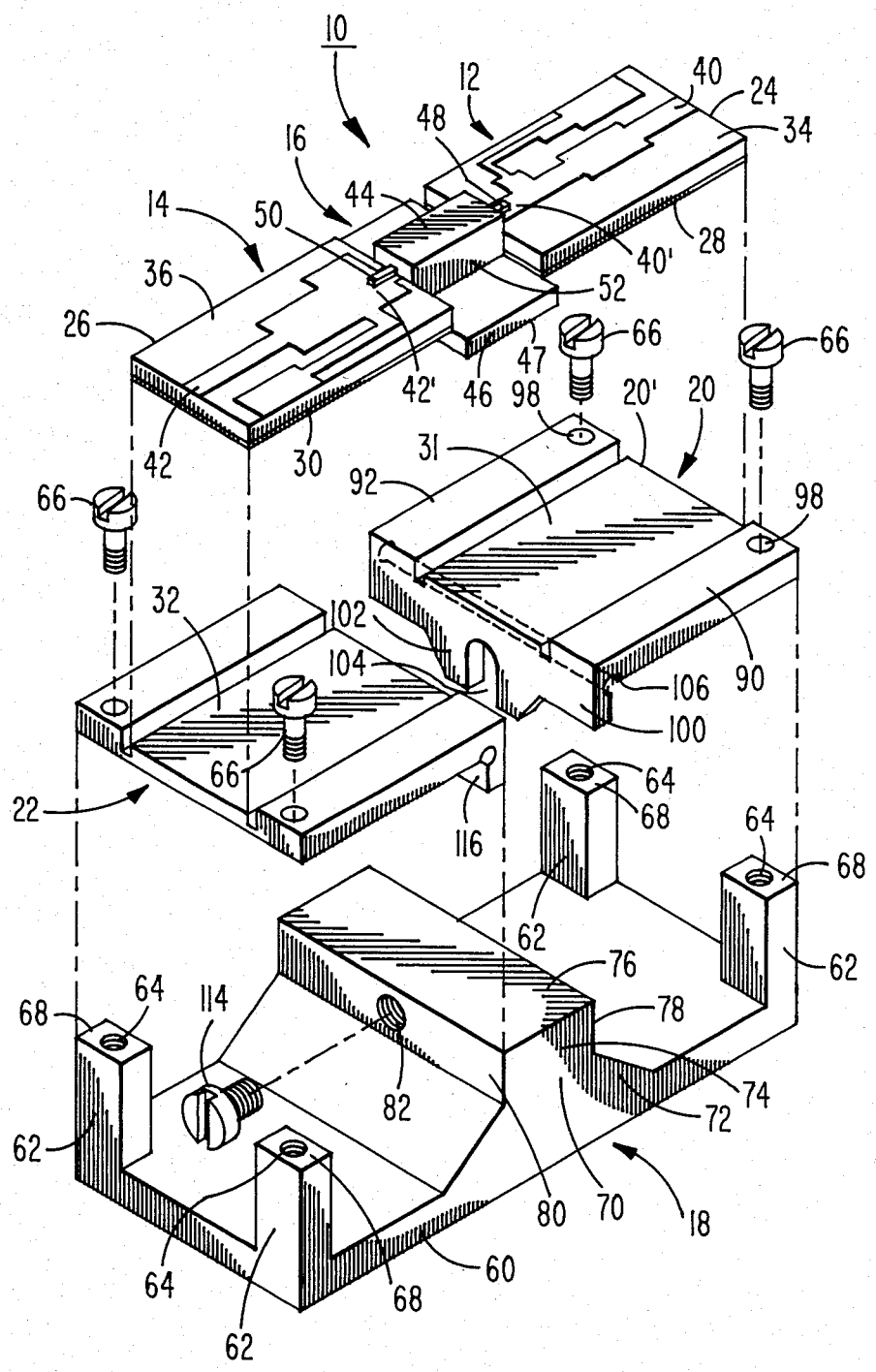
FIG. 1 is an isometric, exploded view of a system according to one embodiment of the present invention.

In FIG. 1, microwave system 10 includes substrate circuits 12 and 14 interconnected by a component 16, e.g., a field effect transistor (FET). The substrate circuits 12 and 14 and component 16 may form a subsystem in a larger system (not shown) including a plurality of similar substrate circuits and components, e.g., field effect transistors (FETs). The system 10 also comprises a metal base 18, which may be aluminum, and a pair of metal mirror image substrate circuit support structures or carriers 20 and 22 secured to the base 18. The carriers 20 and 22 may be made of Kovar. The different elements, as shown in FIG. 1, are illustrated to show their general relationship in the final assembly and do not represent the actual order in which the elements are assembled, which order will be discussed in more detail below.

Substrate circuits 12 and 14 each comprise a thin, sheet-like dielectric substrate 24 and 26, respectively, which may be alumina, having metallized planar conductors 28 and 30, respectively, on the substrate undersurface. Conductors 28 and 30 are soldered directly to the respective electrically conductive carriers 20, 22 at regions 31, 32, respectively. The exposed surfaces 34, 36 of the respective substrates has formed thereon a plurality of microwave plane signal circuits and components which comprise a variety of circuit elements for performing different circuit functions. For example, circuit 12 may comprise an output circuit 40, circuit 14 may comprise an input circuit 42, and component 16 may comprise a FET connected to circuits 40, 42. Circuits 40 and 42 may include capacitive and resistive elements and means for tuning the inputs and outputs in a known manner. Also interconnect circuits (not shown) may be included which interconnect substrate circuits 12 and 14 with other substrate circuits of other subsystem in the overall system (not shown) and as shown in more detail, by way of example, in the aforementioned copending patent application.

In the particular example illustrated, the system 10 is one employed for circuits in which the signals have frequencies in the microwave range, e.g., the gigahertz range. Such signals are impedance sensitive and the impedance at the connections between the various elements of the subsystems is extremely critical.

Figure 3:
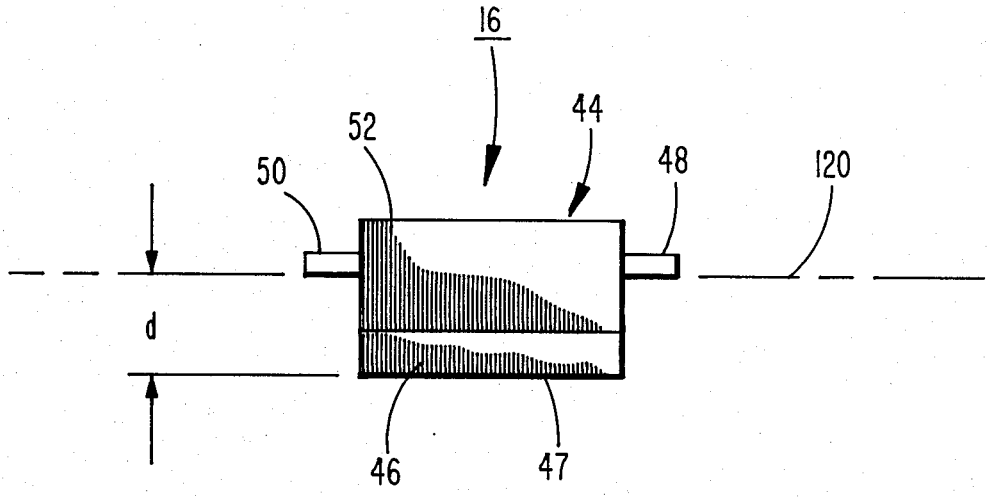
FIG. 3 is a side elevation view of a component implemented in the system of FIG. 1.

One problem has been with assembling the component 16, FIG. 3, to the circuits 12, 14. The component 16 comprises a body 44 which is rectangular in cross-section, as shown. The body 44 includes a metal flange 46, an insulating housing 52 attached to flange 46 and a pair of leads 48, 50, which may be coplanar and extend from the housing 52 in opposite directions. The leads 48 and 50 are spaced from the plane of the exterior lower surface 47 of the flange 46 a distance d. However, distance d may have a manufactured tolerance of $\pm 0.015$ inch from a nominal position. Therefore, the plane 120 in which the leads 48 and 50 lie may be spaced from the surface 47 of the flange 46 a distance d which can vary anywhere within a range of 0.030 inch. This variation of the leads 48 and 50 spacing from the surface 47 can produce problems in the described circuit, as discussed in the introductory portion above.

Figure 2:
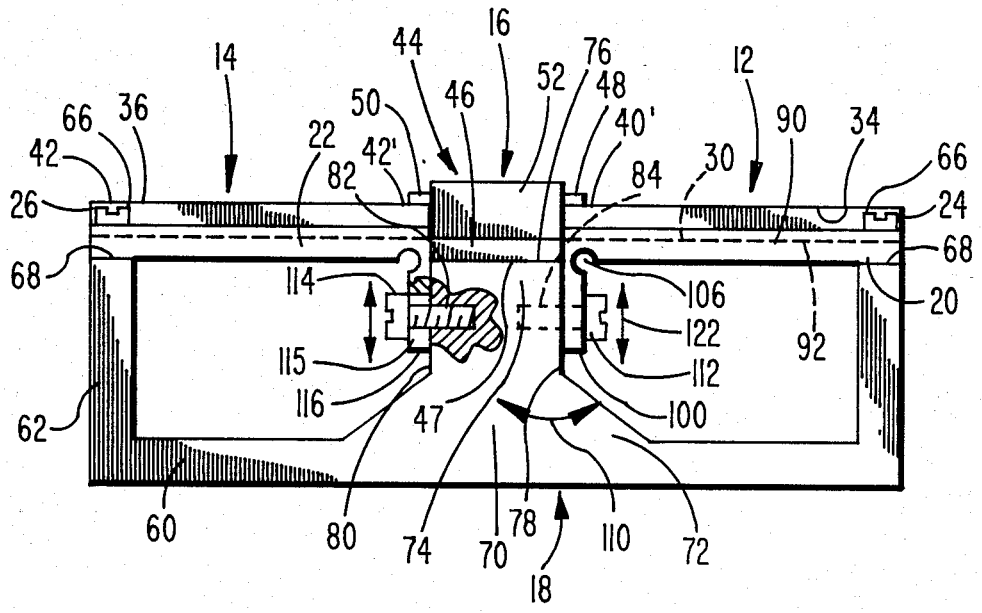
FIG. 2 is a side elevation view, partially in section, of the assembled system of FIG. 1.

In particular, the problems created by the component 16 lead spacing can arise when the component 16 is secured in the system 10, FIGS. 1 and 2. The component 16 is soldered at its surface 47 to the base 18 surface 76 or, as in the prior art, to a mating surface on the interface support structure (not shown). Also, the leads 48, 50 are soldered or welded to the microwave circuits 40 and 42, in particular, to the respective planar conductors 40' and 42', FIG. 1. The conductors 40' and 42' may lie in the same plane and are, in prior art systems, spaced a given fixed distance from the plane of a reference surface of the base 18, such as surface 76, when the substrates are secured in place. However, because the distance d, FIG. 3, between the leads 48 and 50 and the surface 47 may vary among different components in a range of values as described above, the leads 48 and 50 in prior art systems may not always contact the conductors 40', 42', FIG. 1, of the circuits 12 and 14, respectively.

The present invention provides a structure which compensates for the variation in the spacing d among the different components 16 so that the leads 48 and 50 of any randomly selected component will always abut the planar conductors 40', 42' in a given system without bending the leads and without special fabrication of the base 18 to the dimensions of a preselected component. This improved structure tends to preclude the problems mentioned in the introductory portion.

In FIGS. 1 and 2, base 18 comprises a generally planar metal thermally conductive sheet 60, which is rectangular in plan view. Four like posts 62 extend from and may be integral with sheet 60, one at each of the sheet's corners. Each post, which may be of the same material as sheet 60, has a threaded aperture 64 in planar end surfaces 68 for receiving a mating screw 66. Screws 66 secure the carriers 20 and 22 to the respective posts at opposite sheet 60 ends. Posts 62 extend away from the sheet 60 the same distance so that their extended end surfaces 68 are coplanar.

Centrally located on sheet 60 is a thermally conductive heat sink pedestal 70 which may be a metal such as aluminum, and integral with sheet 60. The pedestal 70 has a frustro-triangular (in end view) base 72 secured to sheet 60 terminating in a rectangular (in transverse section) upper portion 74. The portion 74 surface 76 is planar and parallel to post surfaces 68. The pedestal 70 has two parallel transverse sidewalls 78 and 80 normal to surface 76. Threaded aperture 82 is in sidewall 80 and a threaded aperture 84, FIG. 2, is in sidewall 78. Threaded apertures 82 and 84 may be aligned along a common axis normal to walls 78 and 80. The bottom surface 47 of component 16 is soldered to the pedestal 70 surface 76. Thus, the plane 120, FIG. 3, of component 16 leads 48 and 50 is normally parallel to surfaces 68 and 76, but may, in practice, vary somewhat from the parallel orientation.

Only carrier 20 will be described below, as carrier 22 is identical to and positioned in mirror image relation to carrier 20. Carrier 20, FIG. 1, generally comprises a metal sheet 20', which may be Kovar. As described previously, Kovar is an electrically conductive material whose coefficient of thermal expansion matches that of the alumina substrates 24 and 26. Sheet 20' has a planar rectangular region 31 (in plan) bounded on two opposite sides by respective linear ridges 90, 92, which are rectangular in transverse section. Apertures 98 in ridges 90, 92 at one end of carrier 20 receive screws 66 for securing the carrier to posts 62 at one end of base 18.

A flange 100 depends toward base 18 from carrier 20 at an end opposite the end at apertures 98. Flange 100 includes an enlarged central portion 102 in which is formed a slot 104. Slot 104 extends in a direction (directions 122, FIG. 2) generally normal to the planes of region 31 and surfaces 76, 68. Slot 104 is aligned with threaded aperture 84 (FIG. 2) in pedestal 70. A similar slot 115 (FIG. 2) in carrier 22 flange 116 is aligned with threaded aperture 82 in the other pedestal 70 wall 80. Carrier 20 flange 100 abuts pedestal 70 wall 78 and carrier 22 flange 116 abuts pedestal wall 80. Flange 100 depends from region 31 approximately at right angles so that it is generally normal to the plane of substrate 24. Flange 116 is generally normal to the plane of substrate 26, which is ideally coplanar with substrate 24. The joint between flange 100 and the remainder of carrier 20 has a transverse cylindrical undercut 106 and serves as a hinge, as will be explained below.

The undercut 106 extends the full length of flange 100 from the right to the left of the carrier 20, FIG. 1. The undercut 106 hinges the connection of the flange 100 to the region 31 and ridges 90, 92. This hinge permits the flange 100 to be moved in directions 110, FIG. 2, about an axis parallel to the undercut 106 length dimension at the flange 100 junction with the region 31 and ridges 90, 92. Screw 112, FIG. 2, attaches flange 100 to wall 78 of pedestal 70 and screw 114 attaches carrier 22 flange 116 to wall 80 of pedestal 70.

To assemble the system of FIG. 1, the ground plane conductors 28 and 30 of the substrate circuits 12 and 14, respectively, are first soldered to the corresponding regions 31 and 32 of the carriers 20, 22. The component flange surface 47 is soldered to surface 76. Leads 48 and 50 are then aligned respectively, to the planar conductors 40' and 42' on respective substrate circuits 12 and 14. This alignment includes first lightly securing the substrate carrier assemblies 20 and 22 to the corresponding posts 62 with screws 66 such that the carrier assemblies may be moved slightly in directions 122 adjacent pedestal 70. The substrates, prior to tightening the screws 66, are positioned so that conductors 40', 42' on the substrates, FIGS. 1 and 2, are aligned relative to and abut leads 48 and 50, respectively. The alignment above also fixes the position of flanges 100, 116 relative to pedestal 70 Having positioned the leads 48, 50 in the desired aligned orientation, screws 112, 114 are secured to respective threaded apertures 84, 82 to lock flanges 100, 116 to pedestal 70 walls 78, 80. If necessary flanges 100, 116 may be moved about their respective hinges such as in directions 110 for flange 100. The screws 66 are then tightened to lock the carriers 20, 22 and their substrates in place to posts 62. At this point the carriers and substrates are securely fastened to base 18 and component 16 is secured to surface 76 of pedestal 70. The leads 48, 50 are aligned relative to their corresponding conductors 40', 42' on the substrates but not yet soldered in place.

The leads 48 and 50 abut the conductors 40' and 42' and are coplanar therewith at plane 120, FIG. 3, and, therefore, will be relatively stress free after their attachment to conductors 40', 42'. The leads 48, 50 are now soldered to the respective aligned conductors 40', 42', which are fixed in the desired orientation.

The component 16 is located in the space between the carrier regions 31 and 32, FIG. 1. The component 16 end surfaces from which the respective leads 48, 50 project may abut the circuits 12 and 14 and the carriers.

As discussed above, the spacing d (FIGS. 2 and 3) of the component surface 47 (and surface 76 of pedestal 70) to plane 120 at the junction of conductors 40', 42' with component 16 leads 48, 50 may vary for different components. To compensate for this variation in spacing, the substrate-carrier assemblies are moved in directions 122, FIG. 2. This may require flanges 100, 116 be moved relative to respective regions 31, 32 about their hinges, such as at undercut 106, until they abut corresponding walls 78, 80. For example, flange 100 is moved in one of directions 110. This action may tilt the regions 31, 32 somewhat relative to the plane of surface 76 after flange 100 is attached to pedestal 70. This tilting is within a relatively small angle. For example, assume posts 62 are spaced from walls 78, 80 a distance of about one-half inch and assume a maximum spacing d displacement from the nominal of about 0.015 inch. Regions 31, 32 tend to be tilted slightly from a plane parallel to the plane of surface 76 through an angle that is less than one-half a degree. This angle is relatively negligible and has no adverse effect on the operation of circuits 12, 14 since their ground plane conductors 28, 30 are attached to substrates 24, 26 which may be brittle and which do not bend, and therefore, always remain at the same relative spacing to corresponding circuits 40, 42.

The screws 114, 112, assembled to the threaded apertures 82, 84 in the pedestal 70, clamp the respective flanges 100, 116 to the pedestal prior to the soldering of the leads 48, 50 in place to assure no lead bending action occurs after soldering. The slots 104, 115 in the respective flanges 100, 116 permit those flanges to be moved relative to the pedestal in the directions 122, FIG. 2, generally normal to the plane of the circuits 40, 42, during the alignment procedure discussed above and still be aligned with apertures 82, 84, FIG. 2.

The leads 48, 50 of a component 16 may not always be coplanar and may extend from the component 16 at different respective spacing distances d, FIG. 3, such that they lie in different planes rather than in one plane 120. The adjustment structure described can accommodate such different spacing distances.

The surfaces of carriers 20, 22 mating with post surfaces 68 may be tilted somewhat relative to the surfaces 68 as described above, but this too is acceptable as the posts serve only as a supporting base at these locations. The posts' surfaces 68 may be somewhat arcuate, in the alternative to their described planar structure, to alleviate possible stress concentration on the circuits 12, 14 substrates at the edges of posts 62.

The leads 48, 50 of the component 16, being soldered in place to the substrate circuits 12 and 14, and the flange 46 surface 47 being soldered to the pedestal 70, fixes their relative spacing. Once the flanges 100, 116 are positioned in place and the screws 112, 114 secure the flanges 100, 116 to the pedestal 70, the corresponding carriers are also fixed in place without bending the leads 48, 50, and without forcing them under stress into position.

Regardless the variation in distance d from component to component, the leads 48 and 50 are relatively stress free and are in good intimate contact with the respective planar conductors 40', 42'. Further, the leads 48, 50 may be relatively short as they no longer need be a length necessary to accommodate those different spacings. This structure, therefore, accommodates the relative fixed, but different, distances among the different component 16 surfaces 47, pedestal 70 surface 76 and the substrates 12 and 14 to which leads 48, 50 are attached. The present invention tends to avoid potential stress failure of the connections of the leads to the conductors 40', 42' and the filling of the gaps which otherwise might occur between the leads and the planar conductors with solder and thus tends to alleviate introducing a possible impedance mismatch in the resulting circuit. The described structure also avoids cumbersome custom fabricating pedestal 70 to the exact dimensions of a randomly selected component 16 for each assembly to prevent such possible stress and impedance problems. The present system improves the heat transfer paths from device 16, i.e., shortening the lead lengths and eliminating the Kovar thermal resistance between the FET and the aluminum heat sink.

What is claimed is:

1. In a planar microwave circuit system including at least one subsystem, said subsystem including a thermally conductive heat sink base;

an electrically conductive circuit support structure adapted to be secured to said base;

a dielectric substrate secured to the support structure, said substrate having first and second plane surfaces, one of said surfaces including at least one conductor lying in a first plane and being adapted to receive a lead of a circuit component connected thereon, the other surface including a ground plane conductor which is ohmically connected to said support structure, said lead being spaced a given distance from a mounting surface of the component, the improvement comprising:

at least one thermally and electrically conductive component receiving surface on said base to which said component mounting surface can be secured, said receiving surface lying in a second plane spaced from the first plane of said one conductor; and means coupled to said support structure and said base for setting the distance between said first plane and said component receiving surface to substantially the value of said given distance.

2. The system of claim 1 wherein said base includes a pedestal having an extended end surface forming said component receiving surface; and wherein said support structure includes a slotted member adapted to abut said pedestal, and a fastening means passing through the slot of said member and secured to said pedestal for adjustably securing said member to said pedestal along the length of said slot.

3. The system of claim 1 wherein said base includes means for fixedly securing said support structure thereto;

said support structure includes a first member for connection to said ground plane and a second member depending from the first member; and said base and second member includes means adapted for adjustably securing the second member to said base in a direction generally normal to said ground plane.

4. The system of claim 3 wherein said support structure includes hinge means between said first and second members to permit one member to move relative to the other.

5. The system of claim 1 wherein said base comprises a sheet element including post means for fixedly securing said support structure thereto and pedestal means spaced from the post means and having said component receiving surface, said system further including means for adjustably securing said support structure to said pedestal means.

6. The system of claim 5 wherein said means for adjustably securing includes a threaded aperture in said pedestal means, a screw in said threaded aperture; and said support structure includes slotted flange means for adjustable attachment to said pedestal means by said screw at the flange slot.

7. A planar microwave circuit system comprising:

a base member having a component receiving surface;

first and second electrically conductive supports each having a microwave substrate receiving surface, each support secured at one end to said base member;

first and second microwave circuits secured to said first and second supports, respectively, each said circuit comprising:

a planar substrate;

a planar ground plane on one surface of said substrate ohmically connected to its corresponding support; and microwave planar signal circuitry on the opposite surface of said substrate;

each of said signal circuitry including a planar conductor on a surface of said substrate, said planar conductor terminating adjacent said component receiving surface at the other end of the respective support;

said supports and said base member including means adapted to adjust the spacing of the plane of said planar conductors to said component receiving surface in a direction generally normal to the planes of said conductors.

8. The system of claim 7 wherein said means adapted to adjust include means for adjusting the spacing of said first support to said component receiving surface independently of the adjustment of the second support spacing to the component receiving surface.

9. The system of claim 7 wherein said base member comprises a rectangular sheet member including four upstanding posts, each post at a different sheet member corner, said base including a pedestal on which is said component receiving surface, said pedestal being secured centrally on said sheet member, said supports each including means for adjustably attaching said other ends to respective opposite sides of said pedestal.

10. The system of claim 7 wherein said supports each comprise like generally L-shaped members wherein one leg of the L supports a corresponding substrate and the other leg of the L includes means for adjustably securing it to said base.

* * * * *